US006456180B1

(12) United States Patent
Moore

(10) Patent No.: US 6,456,180 B1
(45) Date of Patent: Sep. 24, 2002

(54) LINE INTERFACE TRANSFORMER

(75) Inventor: Robert A. Moore, Franklin, IN (US)

(73) Assignee: Bel-Fuse, Inc., Jersey City, NJ (US)

( * ) Notice: Subject to any disclaimer, the term of this patent is extended or adjusted under 35 U.S.C. 154(b) by 0 days.

(21) Appl. No.: 09/553,713

(22) Filed: Apr. 20, 2000

Related U.S. Application Data

(60) Provisional application No. 60/131,585, filed on Apr. 29, 1999.

(51) Int. Cl.[7] ..... H01F 27/02

(52) U.S. Cl. ..... 336/90; 336/192; 336/229

(58) Field of Search ..... 336/65, 90, 96, 336/192, 107, 208, 225, 229

(56) References Cited

U.S. PATENT DOCUMENTS 4,656,395 A * 4/1987 Fahnrich et al. ..... 336/200
5,656,985 A * 8/1997 Lu et al. ..... 336/96
6,031,442 A * 2/2000 Nakazawa ..... 336/96

* cited by examiner

*Primary Examiner*—Lincoln Donovan
*Assistant Examiner*—Tayler T. Nguyen
(74) *Attorney, Agent, or Firm*—Ostrolenk, Faber, Gerb & Soffen, LLP

(57) ABSTRACT

A line interface transformer having a transformer core disposed in an off center cavity formed in the transformer housing. Line side interface terminals are located on one side of the housing and chip side terminals are located on an opposite side with the cavity being located closer to the chip side terminals than to the line side terminals. The transformer core has a line side winding and a chip side winding with the line side winding being made of a double insulated wire.

2 Claims, 1 Drawing Sheet

LINE INTERFACE TRANSFORMER

This application claims benefit of Provisional application Ser. No. 60/131,585 filed Apr. 29, 1999.

BACKGROUND OF THE INVENTION

In order to meet international safety agencies' standards for transformers connected to a telephone line, three things are required:

1. Supplementary Insulation between the winding connected to the phone line and all other windings and the core. Supplementary means two independent insulation layers in order to ensure protection against electrical shock, and is referred to herein as Requirement No. 1.

2. Clearance distance which is a minimum of 2.0 mm. Clearance distance is the shortest distance between two conductive parts, or between a conductive part and the bounding surface of the equipment, measured through air, and is referred to herein as Requirement No. 2.

3. Creepage distance which is a minimum of 2.5 mm. Creepage distance is the shortest path between two conductive parts, or between a conductive part and the bounding surface of the equipment, measured along the surface of the isolation, and is referred to herein as Requirement No. 3.

In addition to the safety agency requirements, it is also desirable to keep the device as small as possible so as to reduce the required printed circuit board area to an absolute minimum. This is referred to herein as Requirement No. 4.

OBJECT OF THE INVENTION

The object of the invention is to provide a line interface transformer which meets the foregoing safety requirements while minimizing the size of the transformer.

Other features and advantages of the present invention will become apparent from the following description of the invention which refers to the accompanying drawings.

DETAILED DESCRIPTION OF THE PREFERRED EMBODIMENT(S)

Hereinafter, the preferred embodiments of the present invention are explained in detail with reference to the drawings.

Figure 1:
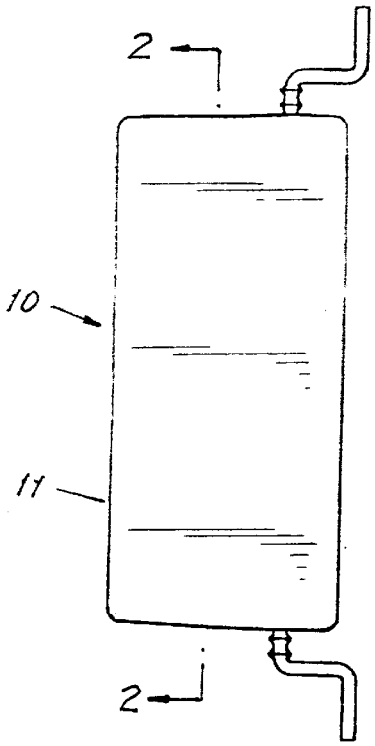
FIG. 1 is a side view of a line interface transformer in accordance with certain aspects of the invention.
Figure 2:
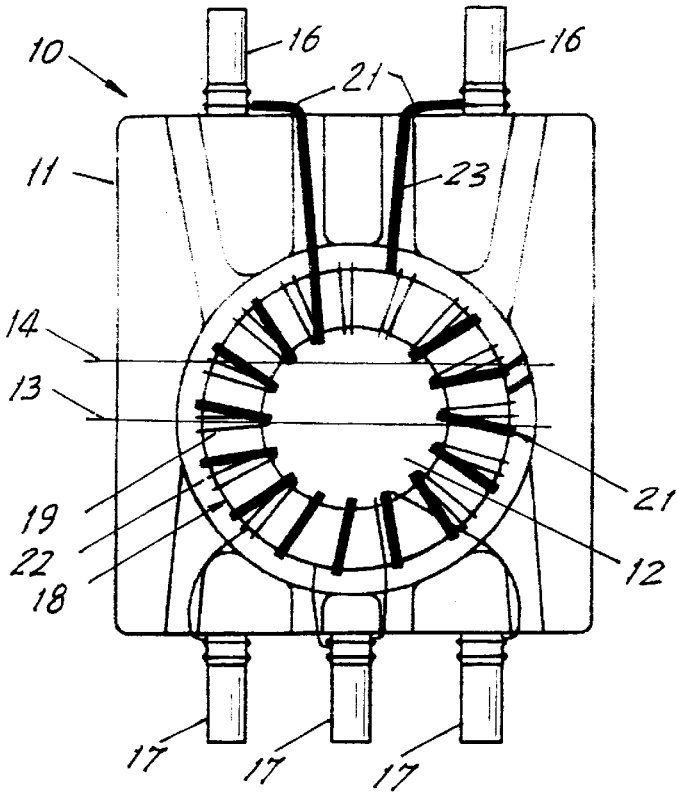
FIG. 2 is a sectional view along the lines 2—2 of FIG. 1.

Referring now to FIGS. 1 and 2, there is shown a line interface transformer 10 in accordance with the present invention.

The line interface transformer 10 includes a plastic housing 11 having a cavity 12 disposed therein, the horizontal center line 13 of the cavity 12 (as viewed in FIG. 2) being offset from the horizontal center line 14 of the housing 11.

The top side of the housing 13 (as viewed in FIG. 2) has line side terminals 16 fixed therein and the bottom side (as viewed in FIG. 2) has chip side terminals 17 fixed therein.

A transformer core 18 having two windings, a line side winding 19 and a chip side winding 21 is disposed in the cavity 12.

Figure 3:
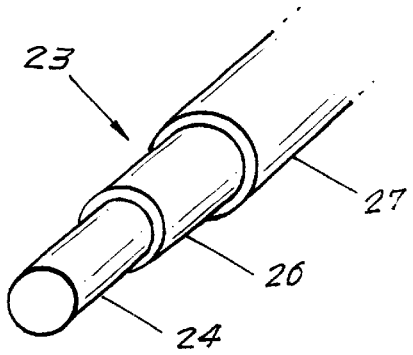
FIG. 3 is a perspective view of double insulated wire used in the line interface transformer of FIGS. 1 and 2.

The winding 19, which is connected to the chip side terminals 17, is comprised of standard magnet wire 22. The winding 21, however, which is connected to the line side terminals 16, is, as seen in FIG. 3, a double insulated wire 23 comprising a conductor 24 having first and second insulation layers 26 and 27 thereon.

Requirement No. 1 is satisfied by using the double insulated wire 23 for the line side transformer winding.

Requirements Nos. 2 and 3 are satisfied by providing sufficient distance from the terminals 16 and 17 and the location of the chip side winding 19. This distance is assured by molding the cavity 12 into the housing 11 at the proper dimension.

Requirement No. 4 is accomplished in combination with the other requirements by moving the center line 13 of the transformer cavity 12 off the center line 14 of the housing 11, thereby reducing the circuit board area requirement to a minimum. In conventional transformer designs, the housing cavity is located centrally in the molding.

It should also be apparent that multiple transformer packages and arrays can also be constructed using the same principle for circuits requiring multiple lines.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A transformer, which comprises:

a housing having a cavity disposed therein with respective center axes of the housing and the cavity spaced from each other;

a first set of conductive terminals located on one side of the housing;

a second set of conductive terminals located an another side of the housing, the spacing between the first set of conductive terminals and the center axis of the cavity being greater than the spacing between the second set of conductive terminals and the center axis of the cavity;

a transformer core disposed in the housing;

a first winding on the transformer core connected to the first set of terminals; and a second winding on the transformer core connected to the second set of terminals.

2. A transformer according to claim 1, wherein the first set of terminals serve as line interface terminals, the second set serve as chip side terminals and the first winding is formed of a wire comprising a conductor having first and second insulating layer thereon.

* * * * *